United States Patent [19]

Spangler et al.

[11] Patent Number: 5,022,547

[45] Date of Patent: Jun. 11, 1991

[54] MULTIPLE FLUID CONTAINER ASSEMBLY

[75] Inventors: Charles W. Spangler, Miami; George G. Dominick, Miramar, both of Fla.; Edward A. Ross, Tuckerton, N.J.; Darrell D. Fish, Baltimore, Md.

[73] Assignee: Coulter Electronics, Inc., Hialeah, Fla.

[21] Appl. No.: 223,126

[22] Filed: Jul. 22, 1988

[51] Int. Cl.[5] ..... B65D 69/00

[52] U.S. Cl. ..... 220/234; 220/23.6; 220/23.86

[58] Field of Search ..... 220/23.2, 23.4, 23.6, 220/23.83, 23.86

[56] References Cited

U.S. PATENT DOCUMENTS

| | | | |
|---|---|---|---|
| D. 219,642 | 1/1971 | Prahs | D9/18 |
| D. 270,135 | 8/1983 | Gates | D9/341 |
| D. 270,237 | 8/1983 | Hestehave | D9/341 |
| D. 292,267 | 10/1987 | Costa | D9/347 |
| D. 292,268 | 10/1987 | Costa | D9/347 |
| 3,225,951 | 12/1965 | Poston et al. | 215/6 |
| 3,658,204 | 4/1972 | Bottger | 220/23.4 |
| 4,143,795 | 3/1979 | Casebier | 220/23.4 |
| 4,235,343 | 11/1980 | Thompson | 215/6 |
| 4,271,965 | 6/1981 | Brambley et al. | 220/23.4 |
| 4,592,478 | 6/1986 | Laconis | 220/23.83 |
| 4,950,083 | 8/1990 | Bavaveas | 220/23.86 |

*Primary Examiner*—Joseph Man-Fu Moy

*Attorney, Agent, or Firm*—Carl Fissell, Jr.; Gerald R. Hibnick

[57] ABSTRACT

A fluid container assembly including one large, relatively narrow container having an orthogonally shaped recess or depression in a wall portion thereof, and two small fluid containers nested within the recess. The recess has means therein engagable with mating means on each of the small containers for retaining the small containers within the recess against accidental dislodgement and so that the external walls of the containers are flush. Each fluid container is provided with a tamper indicating insert such that tampering renders difficult withdrawing fluid.

12 Claims, 2 Drawing Sheets

MULTIPLE FLUID CONTAINER ASSEMBLY

BACKGROUND OF THE INVENTION

1. Field of the Invention

The present invention relates to multiple fluid container systems and more particularly to an assembly wherein a single, large fluid container includes means permitting one or more small containers to be nested therein.

2. Description of the Prior Art

Nestable and/or stackable containers are not new. A variety of such devices are disclosed in the following patents: U.S. Pat. No. 3,225,951 describes a vehicular windshield washer equipment comprising, a washer reservoir of resiliently flexible plastic material having top, bottom and side walls and adapted for attachment to a vehicle, and a washer solvent container adapted to be supported by said reservoir, said reservoir having a recess of dovetail configuration in one of its side walls and said solvent container having a complementary dovetailed projection which terminates in a rim adjacent the top of the container, said projection being adapted to be received in the recess of said reservoir with the rim in engagement with the top wall of said reservoir so as to resiliently support the container on the reservoir; U.S. Pat. No. 3,658,204 describes a set of containers consisting of a small and a large container, particularly for two-component varnishes, which components are to be mixed. The large container is provided with a recess corresponding to the shape and size of the small container and holding means are provided in the recess for interconnection of the two containers. An open vessel, intended for use as a mixing vessel, is arranged to fit around the large and the small container in the area of the recess; U.S. Pat. No. 4,235,343 describes a container assembly comprising one large and two smaller containers, two opposed wall portions of the large container having cavities therein which receive in sliding relation the smaller containers, respectively. The exposed surfaces of the smaller containers blend with the adjacent surfaces of the wall portions thereby to provide an uninterrupted surface contour on the containers so assembled. The cavities provide indentations by means of which the larger container may be conveniently manually grasped; and U.S. Pat. No. 4,592,478 describes a container assembly comprising a pair of liquid containers and a soap bar retention pocket. The retention pocket is integral with the containers and forms an enclosure for housing a bar of soap. A recess in a wall of one liquid container receives a mating projection from a wall of the other container to form the pocket. Alternatively, an independent soap bar container has mating halves received within respective recesses in the liquid containers.

SUMMARY OF THE INVENTION

None of these prior art devices provides an arrangement wherein the filler spout or spouts of a large container are aligned in tandem with the spouts of the small, nested containers, such that all of the spouts are exposed and available for interconnection to other operably associated apparatus or hardware. Where space is at a premium, this feature permits more efficient utilization of the available space. The known prior art devices do not provide securement means for the nested containers, such that the small containers are positionably interchangeable within the nesting area, while still being nestably secured within the larger container. This arrangement includes the use of glues or tapes to prevent accidental dislodgement during handling or transport. None of the prior art container assemblies include weld pillar means or peripheral rib means for strengthening and rigidifying the assembly so as to prevent the side walls of the large container from bulging outwardly when the large container is filled full of fluid.

The present invention comprises a fluid container assembly provided with at least one large and two small fluid containers, each one of which has external walls, one of the external walls of the large container has a wall portion with an elongate, rectangular, orthogonally-shaped depression open at its top for receiving therein the two small containers in nested relation in large container; whereby, when the two small containers are nested in the depression, the external walls of the large and small containers are flush. Oppositely disposed detent means is provided within the depression for retaining the small containers against accidental dislodgement therefrom. The external walls of the large container have one or more weld pillars and one or more circumferential grooves or depressions for rigidifying the large container and maintaining its squareness when it is filled with fluid. The large container has a generally flat top surface and includes fluid filler openings located at opposite ends thereof. Each of the small containers is provided with a fluid filler opening in a top surface. When the small containers are nested within the large container, all of the fluid filler openings of the containers are aligned with each other and in tandem relationship, parallel to the top surface of the large container. This construction enables the container assembly to be received within a relatively narrow, confined opening.

Each fluid filler opening is provided with a filler opening tamper proof insert or plug which: facilitates fluid/reagent withdrawal from all containers, facilitates return of spent or used fluids to waste retention for suitable disposal, requires proper orientation for alignment and connection with operably associated apparatus, and prevents unauthorized refilling by indicating any tampering with the container closure members.

DESCRIPTION OF THE PREFERRED EMBODIMENT

Figure 1:
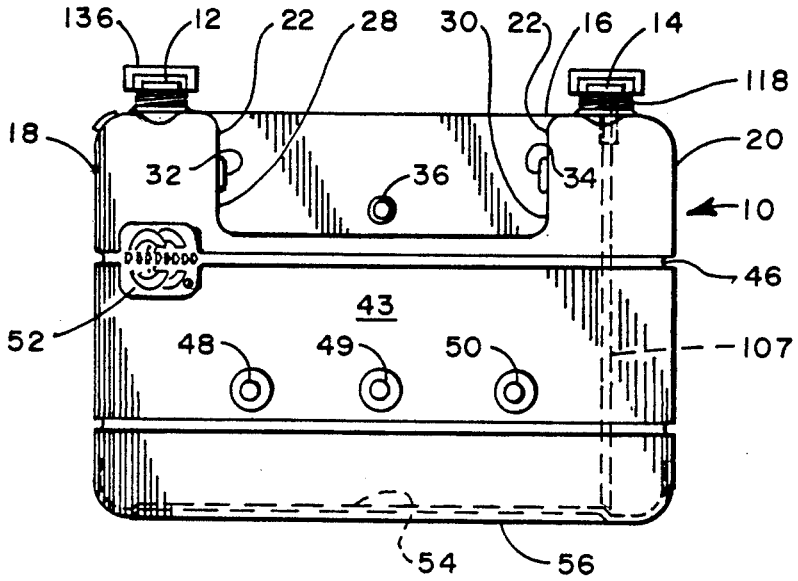
FIG. 1 is a side elevational view of an assembly embodying the present invention.
Figure 2:
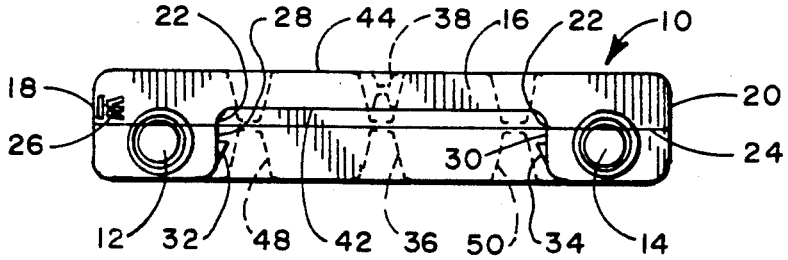
FIG. 2 is a top plan view of the assembly of FIG. 1.
Figure 3:
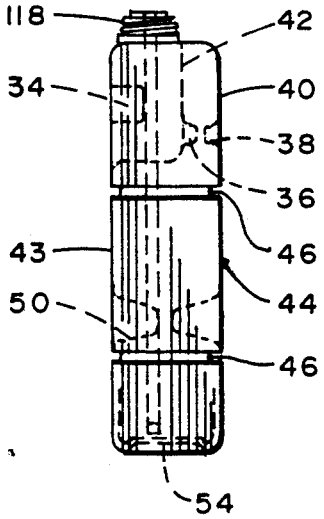
FIG. 3 is an elevational end view of the assembly of FIG. 1.

The present invention is embodied in the container assembly illustrated in FIGS. 1-14 and includes a large container 10. Container 10 is illustrated in FIG. 1 as a relatively narrow, rectangular, plastic member provided with oppositely disposed filler necks or spouts 12 and 14 at opposite ends of an otherwise substantially flat top surface 16. The spouts 12 and 14 are arranged in tandem, but are disposed off center relative to the center line of the flat top surface 16, for purposes to be explained shortly. The container 10 has end walls 18 and 20. Centrally disposed, intermediate the ends 18 and 20, is a large, orthogonal, rectangular cavity, pocket or recess 22 molded or otherwise formed therein, extending across the width of container 10, and slightly beyond the midpoint of a center line 24, shown in FIG. 2, dividing the container longitudinally from end 18 to end 20. The large container 10 is adapted to be employed in a two-fold manner thereby making its utilization both more efficient than if two such containers were required. In the first instance container 10 contains one of a plurality of fluids used in the apparatus with which the container 10 is operably associated. In the second instance the container 10 is reemployed as a waste receptacle or repository for all of the spent fluids resulting from the operation of the associated apparatus. For this latter purpose, the container 10 includes the embossed letter W for waste (indicated by reference character 26) at one end thereof, as will be described later on herein.

The recess 22 has opposed, facing walls 28 and 30; molded or formed into which are individual retention or detent means in the form of wedge shaped protuberances 32 and 34, to be detailed subsequently.

Weld pillars 36 and 38 also are molded into a portion 40 of front and back walls 42 and 44, respectively, of the recess 22 and together act to rigidify this portion of the container 10 against bulging when the container is filled with fluid material. Disposed circumferentially about external walls 43, 44 of the container 10 are one or more rigidifying channels or depressions 46, as seen in FIG. 1, which act to strengthen the container side walls. Three enlarged weld pillars 48, 49 and 50, molded into the front and back side walls 43 and 44, respectively, rigidify the container 10 and also prevent the walls 43 and 44 from bulging outwardly when the container 10 is being filled or is full of fluid. As part of the upper rigidifying channel 46, the registered logo 52 of Coulter Electronics, Inc. is molded into the front side wall 43. A rigidifying, rectangular push-up 54 also is molded into bottom 56 of the container 10, as seen in FIG. 1.

Figure 9:
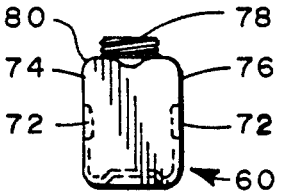
FIG. 9 is a side elevational view of another one of the small containers for use with the assembly of FIGS. 1 or 4.

For retention within the recess or depression 22 there are provided two small containers 58 and 60, FIGS. 5 to 9, which in the present embodiments are illustrated as two different sized bottles for containing two different reagent fluids. The larger container 58 is substantially rectangular in outline configuration and includes a centrally disposed filler spout 62 at its top 64. Opposite respective end walls 66 and 68 have a wedge shaped depression 70 molded or formed therein. The smaller container 60 is illustrated in FIG. 9, also is substantially rectangular in shape and includes a wedge shaped depression 72 on each opposite end wall 74 and 76. A filler spout 78 is disposed at the center of the top 80 of the container 60. Since both of the two smaller containers 58 and 60 are provided with oppositely disposed, wedge shaped indentations, recesses or depressions, they can be reversedly positioned within the rectangular recess 22.

It should be readily apparent from the foregoing that the protuberances 32, 34 mate with the depressions 70, 72 such that once the two small containers 58 and 60 have been disposed together in the recess 22, they are semi-rigidly locked in place and will not fall out of the recess 22 regardless of the physical position of the large container 10. It should be noted at this juncture that the size of the two smaller containers with respect to the size of the recess 22 is such that the two small containers make a semi-press fit when received within the recess 22.

Figure 4:
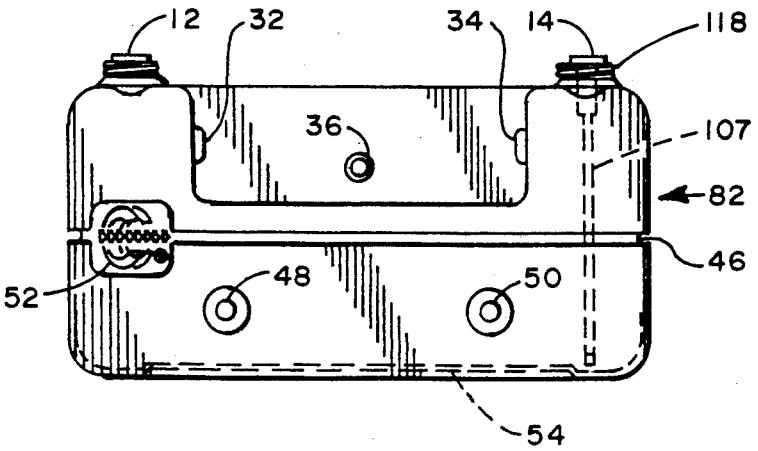
FIG. 4 is a side elevational view of a smaller size container embodying the present invention.
Figure 5:
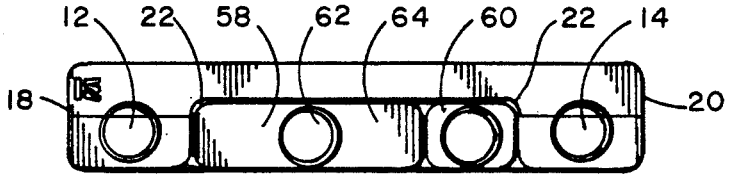
FIG. 5 is a top plan view of the assembly of FIGS. 1 or 4 with additional small containers nested in place.
Figure 7:
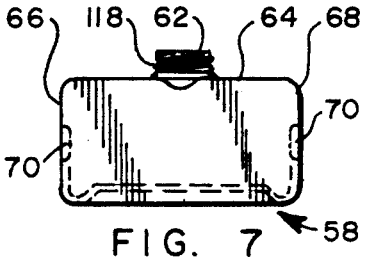
FIG. 7 is a side view of one of the small containers for use with the assembly of FIGS. 1 or 4.
Figure 6:
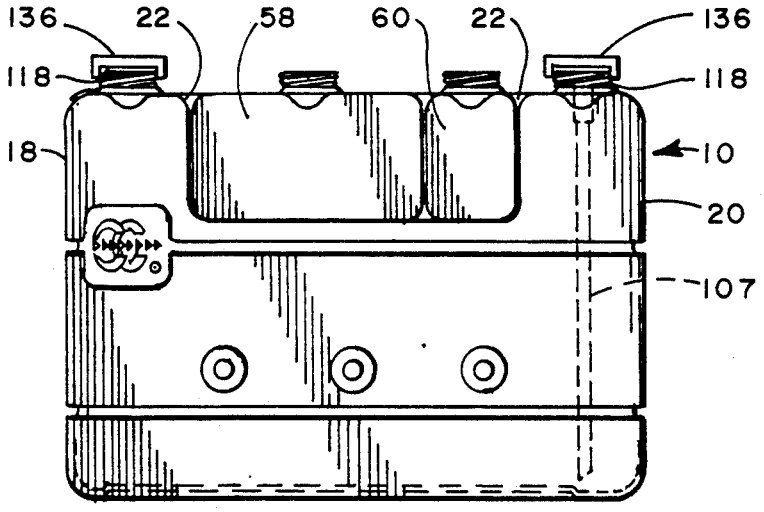
FIG. 6 is a side view of the large container of FIG. 1 with two small containers nested therein.
Figure 8:
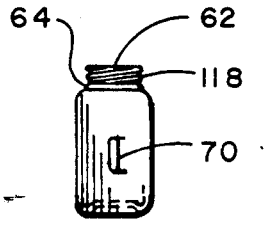
FIG. 8 is an end view of the container of FIGS. 7 and 9.

Due to the variation in reagent consumption by different users, a smaller volume container 82, that is shorter top to bottom, is provided, as illustrated in FIG. 4. The container 82 is otherwise substantially identical to the container 10 of FIG. 1, but about a third shorter from top to bottom than the container 10. This size difference is of no significant consequence with respect to the structural support and nesting arrangement of the two small containers 58 and 60.

During the initial utilization of the container assembly of this invention, the large container 10 and/or 82 contains a fresh supply of fluid as do the two small containers 58 and 60. Once the container 10, 82 is emptied of fluid, the entire multiple fluid container assembly is physically removed from its "input" operating position in the analyzer, turned end for end, so as to position the waste identified filler spout 12, adjacent the W, into position to receive the waste fluid material generated by the analyzer during the next operation thereof.

The problems associated with container package tampering and contaminating are well known and are still a major problem of the container packaging industry. An additional problem is associated with the reagents manufacturing industry, in which many reagents are not compatible when brought together, as when accidentally mixed prior to or during reaction and analysis. In addition, certain chemical processes require, as an absolute, a precise amount, purity and type of reagent in order for a specific chemical or other analysis/reaction to take place.

Figure 12:
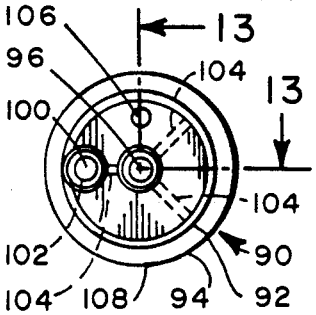
FIG. 12 is a bottom view of the filler opening insert plug.
Figure 13:
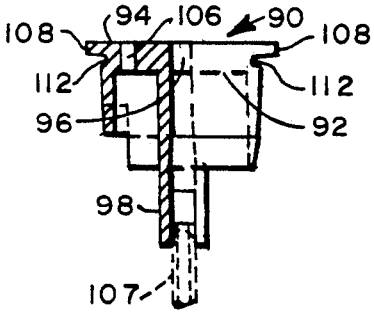
FIG. 13 is a sectional side view of the insert plug.

The present invention solves these and other problems associated with container tampering by adding to the fluid container assembly a fluid filler plug, fitment, or insert 90 shown most clearly in FIGS. 12 and 13. The insert 90 comprises a substantially circular, plug-like member 92 of plastic or other similar material which is basically chemically inert with respect to the chemical reagents with which it is to be utilized. The member 92 is a molded, one piece, open at the top, cylindrical structure including an integral, thin, flat, circular top portion 94 forming a closure for the open filler necks or spouts 12 and 14 of the containers 10 and 82 as well as for the spouts 62 and 78 of containers 58 and 60. A circular through hole 96 and a short length of plastic pipe 98 are disposed centrally of the member 94. A second through hole 100 and a short pipe 102 extending therefrom are arranged adjacent to the central hole 96 and the pipe 98.

A trio of relatively thin walled vanes 104 extends outwardly from the center pipe 98 in order structurally to rigidify the member 92. A third aperture or hole 106 is disposed in the member 92 and is slightly offset from the other two holes, as seen in FIG. 12, and forms a vent aperture for each container in the assembly. A secondary length of tubing 107 is secured to the pipe member 98 and extends almost to the bottom of each container 10 and 82. This permits the withdrawal of the maximum volume of fluid from the containers 10, 82, 58 and 60.

The top of the cylindrical member 92 is formed as a relatively thin structure and is arranged to provide a circular, narrow, rim portion 108 sufficiently wide to engage the top of the bottle neck with which it is associated and, together with a cap 110 (to be described with reference to FIGS. 10, 11), to seal the internal volume of each bottle or container 10, 58, 60 and 82 from the ambient atmosphere. Thus the contents of the various bottles or containers are capable of being withdrawn without the introduction of air bubbles into the fluid. The introduction of the air can and indeed sometimes in the past has caused bubbles to form in the fluid. The present structural arrangement avoids this type of bubble contamination.

Figure 14:
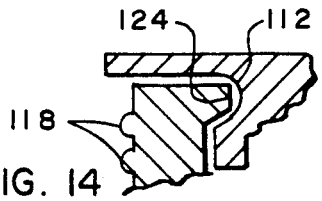
FIG. 14 is a detail sectional view of an upper edge portion of the insert plug and container filler opening.

Immediately beneath and contiguous with the rim portion 108 is a molded, circular indentation, groove or recess 112, shown in FIGS. 13 and 14, including a downwardly angled or canted area 114, sloping outwardly away from the root portion of the circular recess 112. As seen most clearly in FIG. 15, the external neck 116 of each container is threaded circularly, as at 118. The internal portion 120 of the neck 116 of the container is a smooth cylinder except for the topmost internal rim portion 122 which latter portion includes an integral circular, protuberance 124 FIG. 15. The inwardly extending circular protuberance 124 provides a mating anular edge for engagement with the molded circular depression 112 in the insert member 92 and acts to tightly secure the insert member 92 to the container/-bottle neck 116, and also seals the internal contents from the ambient atmosphere. This arrangement discourages removal without damage.

The flat top 94 of the member 92 is dimensioned to create a flat seal face to mate with the caps 110 of a machine connector 126, as well as with transport caps 136. Damage to the seal face can destroy the seal and introduce air into fluid reagent draw. In addition, the minimal thickness of the rim portion 108 discourages prying since, in attempting to pry the insert 90 from the bottle neck 116, the exceptionally small or tiny rim area 108 tends to break away or rupture around the edge, which indicates to the operator that tampering has occurred. Also, this damage destroys the sealing arrangement of the machine connector caps 110.

Figure 11:
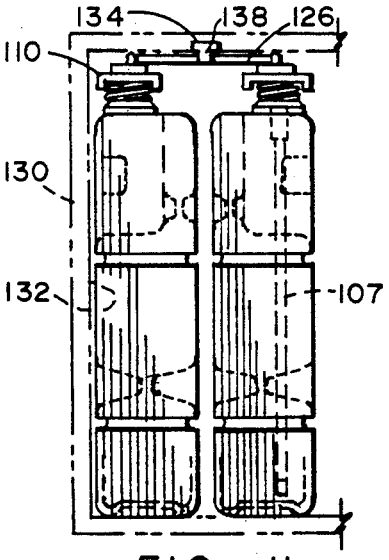
FIG. 11 is a phantom view of a portion of the associated apparatus within which the containers of FIGS. 1, 4 and 6 are mounted.

The fluid container assembly is adapted to be used within an apparatus, for example, a blood cell analyzer 130, only a small Portion of one end of which is shown in phantom in FIG. 11. This analyzer is configured to provide a compartment 132 at one side, for housing two fluid container members 10. The compartment 132 is provided with a top mounted guide rail 134 which extends from the front of the compartment toward its back.

Figure 10:
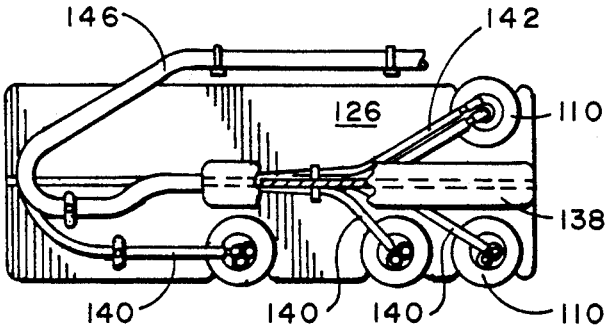
FIG. 10 is a top plan view (not to scale) of the demountable container cap attachment and reagent tubing harness.

Each container 10, 82, 58, 60, when shipped full of reagents to the customer, is sealed by a transporting cap 136 until the three containers are placed in use within the compartment 132 of the analyzer 130. Just prior to use in the analyzer, the temporary shipping caps 136 are removed and the machine connector 126, with its associated parts, as seen in FIG. 10, is secured in place by attachment of its individual, freely rotatably, mounted caps 110 to the necks 116 of the various individual fluid container bottles. A second, empty, large container 10, or 82 with the W (waste) indication exposed to view, is attached by its neck portion 116 to the appropriate cap 110 of the harness member 126. Thereafter, an integral channel 138 of the connector 126 is engaged with the top mounted guide rail member 134 of the machine 130; and the container assemblies are pushed backward into the compartment 132. The interconnection of various reagent withdrawal tubes 140 and waste tubing 142 is accomplished automatically by means of a tubing harness 144, for introducing the reagents into the analyzer 130 and for withdrawing the spent or waste products therefrom.

What is claimed is:

1. A fluid container assembly comprising: one large and at least two small fluid containers all having external walls, one of said external walls of said large container having a wall portion with an orthogonally shaped depression for receiving therein said two small containers in nested relation to said large container; whereby, when said two small containers are nested in said depression said external walls of said large and small containers are flush; retaining means for retaining said small containers within said depression against accidental dislodgement therefrom; said large container having a generally flat top surface with fluid filler openings at opposite ends thereof; each of said small containers having a fluid filler opening in a top surface; all said fluid filler openings of said containers being aligned with each other and in tandem relationship, parallel to said top surface of said large container.

2. The fluid container assembly of claim 1 wherein said external walls of said large container include one or more weld pillars for rigidifying said large container and maintaining its squareness when it is filled with fluid.

3. The fluid container assembly of claim 1 wherein said depression is rectangular in shape, has opposite internal facing walls and a central facing wall, and is centrally disposed in said large container, intermediate the ends thereof.

4. The fluid container assembly of claim 3 wherein each opposite internal facing wall of said depression is provided with a wedge shaped protuberance which defines a portion of said retaining means.

5. The fluid container assembly of claim 1 wherein the central facing wall of said depression includes a weld pillar for maintaining squareness and rigidity of this portion of the large container.

6. The fluid container assembly of claim 1, wherein each of said small fluid containers includes a wedge shaped depression on opposite side walls thereof for mating engagement with said wedge shaped protuberances of said depression.

7. The fluid container assembly of claim 1, wherein each of said fluid filler openings includes a filler opening insert having fluid filler tamper indicating means engageable with said fluid filler opening, to prevent refilling of said container assembly without indicating tampering of said fluid filler opening insert.

8. The fluid container assembly of claim 7, wherein said fluid filler tamper indicating means comprises circular indented means on said filler opening insert and circular projection means on said fluid filler opening;

said indented means being receivable within and engageable in pressed fit relation with said circular projection means on said fluid filler opening, whereby said insert is secured within said fluid filler opening and tampering is indicated.

9. The fluid container assembly of claim 7, wherein said tamper indicating means further comprises a circular angular protuberance disposed in said fluid filler opening and a ring-like recess integral with said insert, said circular angular protuberance in said fluid filler opening engaging said ring-like recess of said insert so as to seal said fluid filler opening.

10. The fluid container assembly of claim 1 further comprising, a demountable, movable container closure and tubing harness which includes one or more container closure caps, for sealing said container assembly from the atmosphere, and mounting means integral with said container closure for slidably, removably mounting said container assembly within a compartment of an operably associated apparatus.

11. The fluid container assembly of claim 10, wherein said mounting means comprises an I-beam channel integral therewith and an elongated slot integral with said operably associated apparatus whereby said I-beam channel is slidably, removably receivable in said slot.

12. The fluid container assembly of claim 10, wherein said container closure caps are removably, rotatably trapped on said container closure and tubing harness member.

* * * * *